US010543980B1

(12) United States Patent
Rogers

(10) Patent No.: US 10,543,980 B1
(45) Date of Patent: Jan. 28, 2020

(54) ROLL-OFF TUB STYLE CONTAINER

(71) Applicant: Ralph R. Rogers, Dakota Dunes, SD (US)

(72) Inventor: Ralph R. Rogers, Dakota Dunes, SD (US)

( * ) Notice: Subject to any disclaimer, the term of this patent is extended or adjusted under 35 U.S.C. 154(b) by 0 days.

(21) Appl. No.: 16/117,505

(22) Filed: Aug. 30, 2018

Related U.S. Application Data

(62) Division of application No. 14/316,014, filed on Jun. 26, 2014, now Pat. No. 10,118,760, which is a division of application No. 13/068,275, filed on May 6, 2011, now Pat. No. 8,833,580.

(51) Int. Cl.
*B65D 90/24* (2006.01)
*B65D 88/12* (2006.01)

(52) U.S. Cl.
CPC ..... *B65D 90/24* (2013.01); *B65D 88/123* (2013.01); *B65D 2588/125* (2013.01); *B65D 2590/24* (2013.01)

(58) Field of Classification Search
CPC ..... B60P 1/30; B60P 1/6427; B60P 1/433; B60P 1/28; B65F 1/122
USPC ..... 220/2.1, 729, 562, 1.6; 414/491
See application file for complete search history.

(56) References Cited

U.S. PATENT DOCUMENTS

| | | | | |
|---|---|---|---|---|
| 3,204,789 | A | 9/1965 | Riedel et al. | |
| 3,255,906 | A | 6/1966 | Proler et al. | |
| 3,342,522 | A | 9/1967 | Palen et al. | |
| 3,521,773 | A | 7/1970 | Geister | |
| 3,586,189 | A | 6/1971 | Tornheim | |
| 4,623,197 | A | 11/1986 | Stluka | |
| 5,026,228 | A | 6/1991 | Mansfield | |
| 5,145,309 | A * | 9/1992 | Foster | B65D 90/24 198/750.2 |
| 5,169,194 | A | 12/1992 | Yamashita et al. | |

* cited by examiner

*Primary Examiner* — Shawn M Braden
(74) *Attorney, Agent, or Firm* — Dennis L. Thomte; Thomte Patent Law Office LLC

(57) ABSTRACT

A roll-off tub style container which is leak-proof to prevent liquids in the container from draining onto the ground or roadways. In one embodiment of the invention, the floor of the container has an upwardly and rearwardly extending inclined portion at the rearward end thereof to prevent liquid in the container from coming into contact with the tail gate of the container. In another embodiment of the invention, the rearward end of the container is elevated during transport to prevent liquid in the container from coming into contact with the tail gate. In yet another embodiment of the container, the floor of the container is inclined upwardly and rearwardly from the forward end thereof to the rearward end thereof. A liquid collection tank may be positioned beneath the floor of the container which has an inlet in fluid communication with the interior of the container and a discharge outlet provided thereon to permit liquid in the tank to be selectively drained therefrom.

1 Claim, 10 Drawing Sheets

ROLL-OFF TUB STYLE CONTAINER

CROSS REFERENCE TO RELATED APPLICATION

This is a Divisional Application of application Ser. No. 14/316,014 filed Jun. 26, 2014, entitled ROLL-OFF TUB STYLE CONTAINER, which is a Divisional Application of application Ser. No. 13/068,275 filed May 6, 2011, entitled ROLL-OFF TUB-STYLE CONTAINER, now U.S. Pat. No. 8,833,580.

BACKGROUND OF THE INVENTION

Field of the Invention

This invention relates to a roll-off tub style container and more particularly to a roll-off tub style container which is designed to prevent liquids therein from leaking from the tail gate at the rearward end thereof.

Description of the Related Art

Roll-off tub style containers are commonly used for transporting construction and demolition material, municipal sold waste, general waste, yard waste, recycling materials, scrap metal, etc. A vast majority of the roll-off tub style containers have a tail gate or end gate at the rearward end thereof which selectively closes the rearward end of the tub. If the material being collected and transported contains liquid, that liquid may leak from the container at the tail gate area. In most cities and states, it is an offense if liquid leaks from the container during collection or transport.

Some roll-off tub style containers utilize gaskets or seals around the tail gate in an attempt to prevent leakage of the liquid from the container. However, those gaskets or seals are quickly rendered useless by their engagement with the materials being dumped through the end of the container. Further, in cold weather conditions, the gaskets or seals will become frozen and rendered inoperative.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In one embodiment of the invention, the roll-off tub style container comprises first and second longitudinally extending and horizontally spaced-apart frame members having forward and rearward ends with a floor positioned on the frame members with the floor having a forward end, a rearward end, a first side and a second side. A forward wall extends upwardly from the forward end of the floor between the first and second sides thereof. A first side wall extends upwardly from the floor at the first side thereof with the first side wall having forward and rearward ends. A second side wall extends upwardly from the floor at the second side thereof and has forward and rearward ends. The floor has a horizontally extending front floor portion with forward and rearward ends and an inclined rear floor portion which extends upwardly and rearwardly from the rearward end of the front floor portion. A selectively closable tail gate is provided at the rearward ends of the first and second side walls and the rearward end of the inclined rear floor portion to maintain material in the container. The inclined rear floor portion functions as a liquid collection area with the liquid therein being spaced forwardly of the lower end of the tail gate to prevent the liquid from leaking through the tail gate.

In another embodiment of the invention, the inclined rear floor portion is omitted. In this embodiment, a means is provided for raising the rearward end of the container from the truck frame during transport of the container which prevents liquid in the container from coming into contact with the tail gate at the rear end of the container.

In a further embodiment of the invention, a liquid collection tank is mounted at the underside of the floor at the rearward end thereof and is fluidly connected to the interior of the container so that liquid in the container will drain into the collection tank. The collection tank also has a discharge valve associated therewith so that liquid in the collection tank may be drained therefrom as desired.

It is therefore a principal object of the invention to provide an improved roll-off tub style container.

A further object of the invention is to provide a roll-off tub style container which is designed to prevent liquid from leaking from the container during collection and transport.

A further object of the invention is to provide a leak-proof roll-off tub style container.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
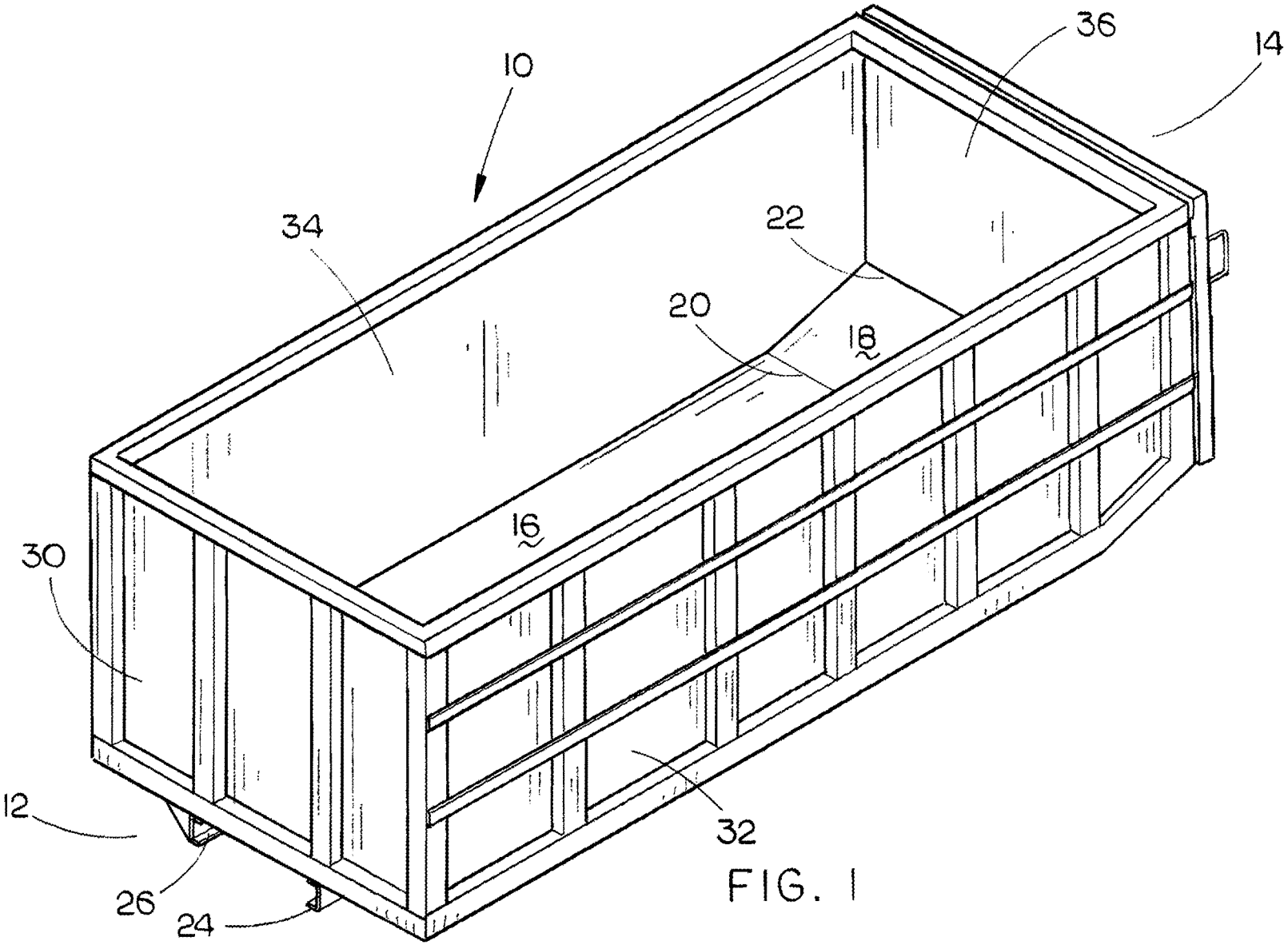
FIG. 1 is a front perspective view of one embodiment of the invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to one embodiment of the roll-off tub style container of this invention. Container 10 will be described as having a forward end 12 and a rearward end 14. Container 10 includes a front floor portion 16 which extends horizontally rearwardly from the forward end of the container 10. Container 10 also includes an inclined rear floor portion 18 which extends upwardly and rearwardly from the rearward end 20 of front floor portion 16. For purposes of description, rear floor portion 18 will be described as having a rearward end 22.

Floor portions 16 and 18 may be supported upon by a pair of longitudinally extending frame members 24 and 26 if so desired to add strength and rigidity to the container. A pair of roll-off wheels 28 are preferably secured to the rearward end 22 of floor portion 18. If desired, a pair of roll-off wheels may also be secured to the forward end of the container.

A front wall 30 extends upwardly from the forward end of front floor portion 16. Side wall 32 extends upwardly from floor portions 16 and 18 at one side thereof. Side wall 34 extends upwardly from floor portions 16 and 18 at the other side thereof. A roll-off door or tail gate 36 selectively sealably closes the rearward end of the container 10. When closed, tail gate 36 engages the rearward ends of side walls 32 and 34 and the rearward end of floor portion 18.

Figure 2:
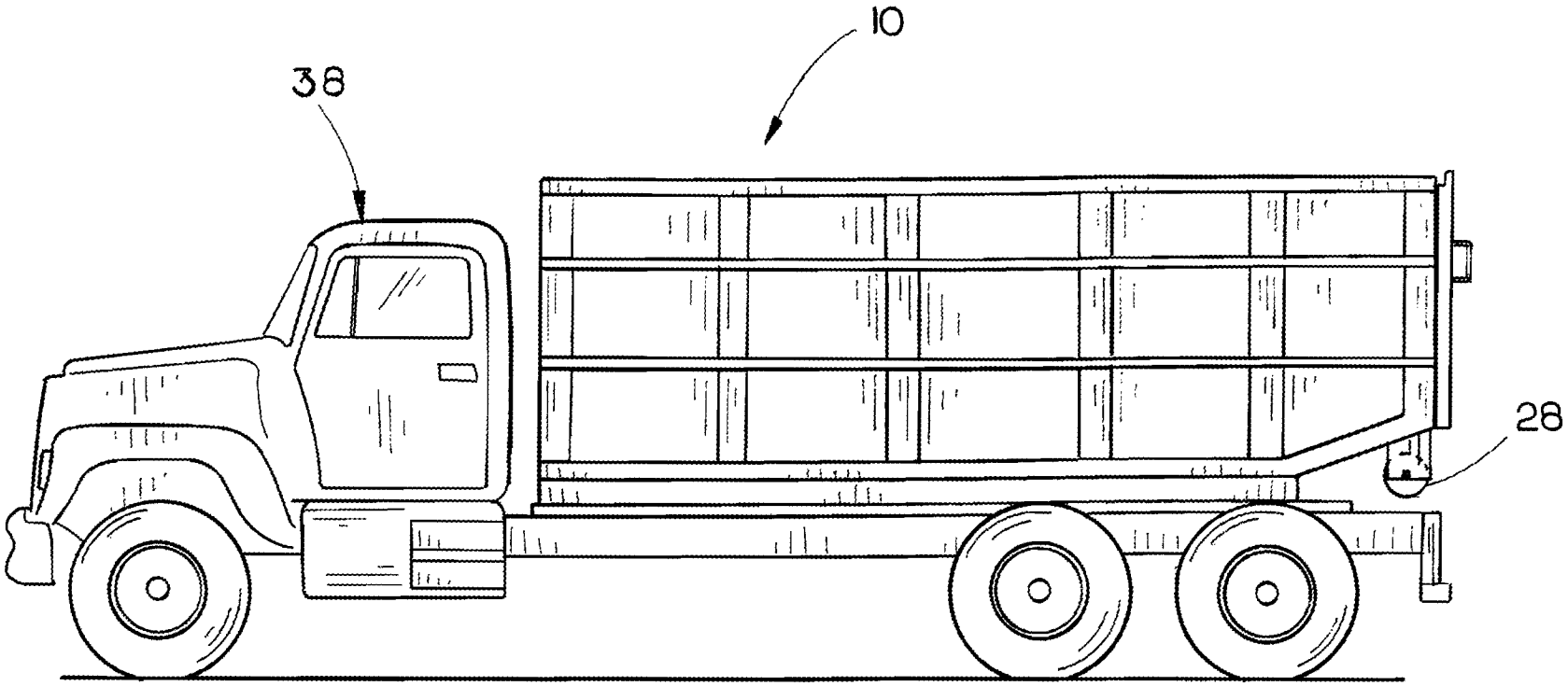
FIG. 2 is a side view illustrating the container of FIG. 1 mounted on a truck for transport.

The positive inclined or tapered floor portion 18 at the rearward end of the container will prevent liquids from leaking out of the container while the container is in a transport position or is in its static sitting position. The floor portion 18 essentially provides a reservoir or liquid collection area for liquids to accumulate therein and which prevents the liquid from coming into contact with the tail gate 36. FIG. 2 illustrates the container loaded onto a truck 38.

Figure 3:
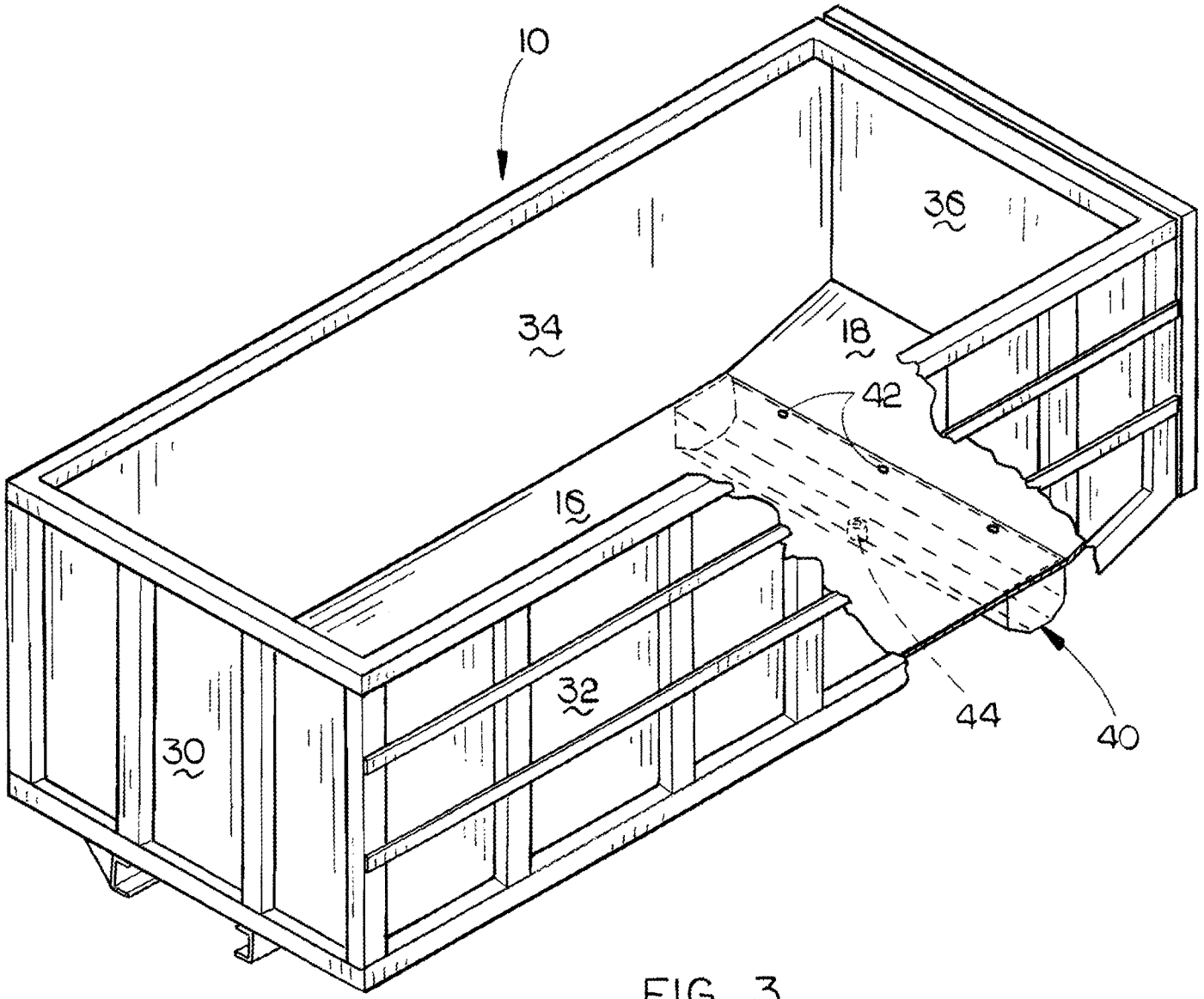
FIG. 3 is a partial front perspective view of an embodiment wherein a liquid collection tank is place beneath the floor of the container of FIG. 1.
Figure 4:
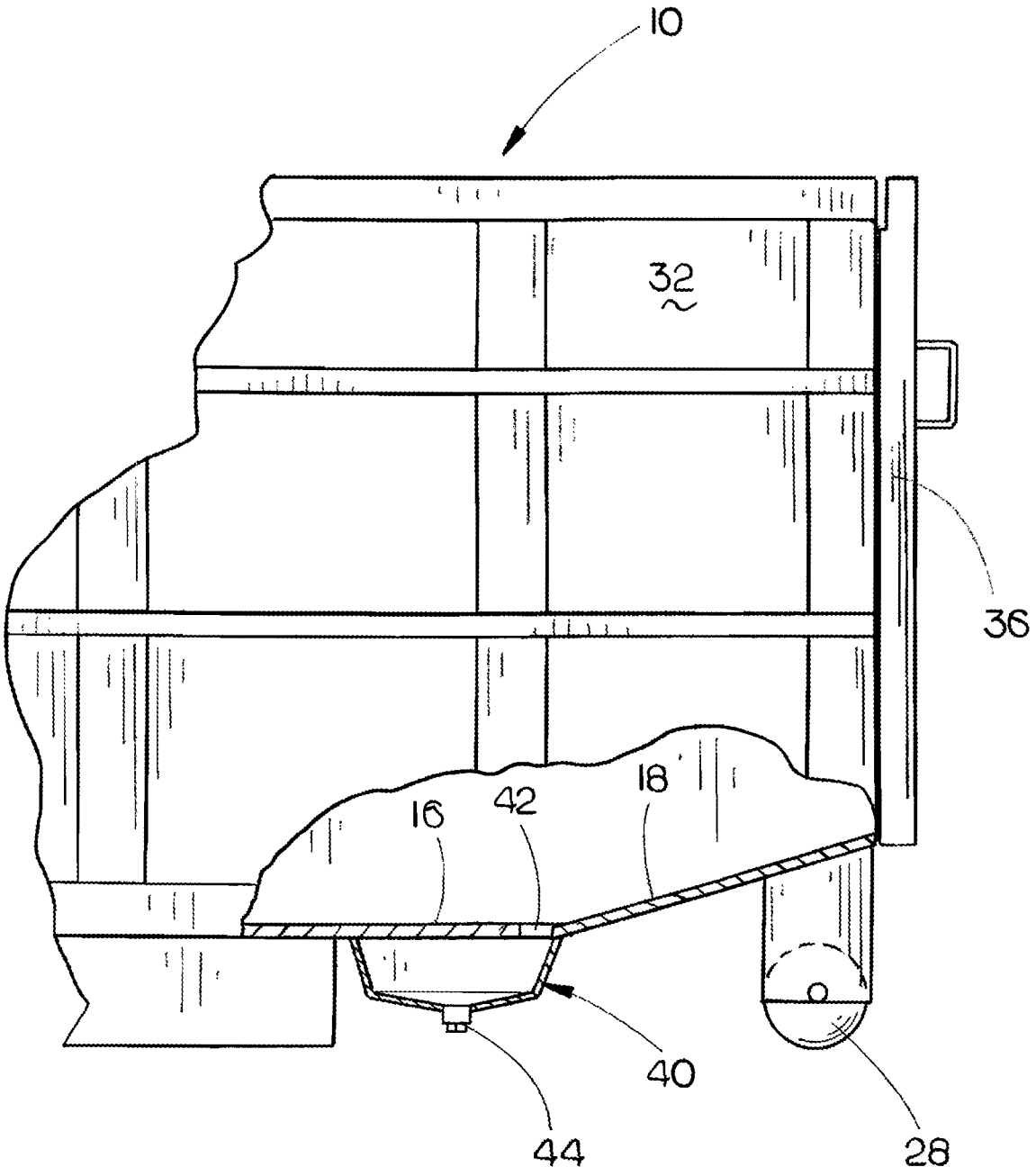
FIG. 4 is a partial side view of the embodiment of FIG. 3 with portions thereof cut-away to more fully illustrate the invention'

FIG. 3 illustrates a further embodiment of the invention. A liquid collection tank 40 is positioned beneath floor portion 16 at the rearward end thereof and has one or more inlet openings 42 formed therein which communicate with the interior of the container 10 at the rearward end of floor portion 16 so that liquid in the container 10 may drain thereinto. Tank 40 has a discharge valve 44 provided in the bottom thereof to permit the liquid therein to be drained therefrom.

Figure 5:
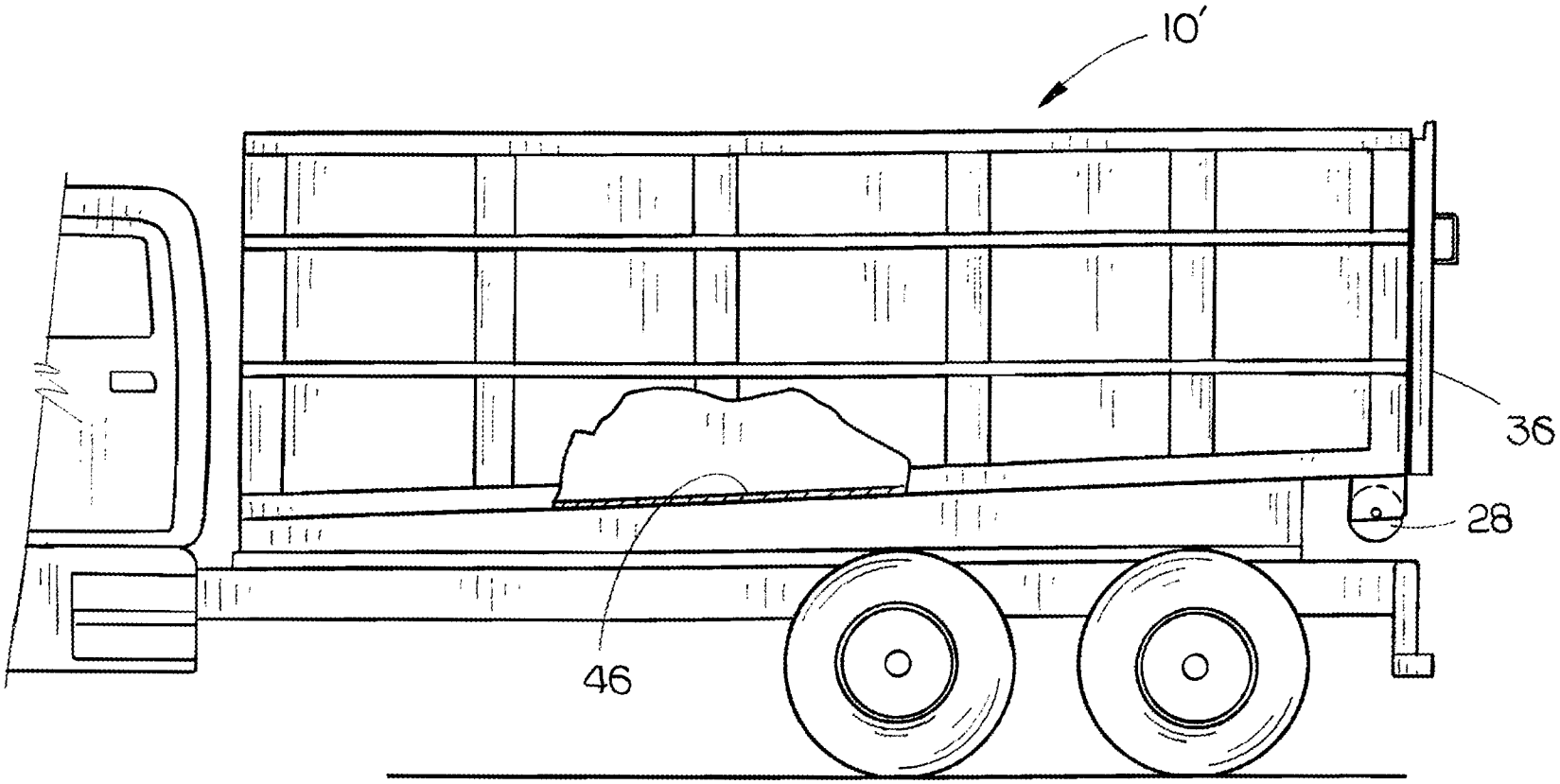
FIG. 5 is a sectional view of a further embodiment of the container of this invention.

FIG. 5 illustrates a third embodiment of the container. In FIG. 5, the container 10' has a floor 46 which extends upwardly and rearwardly from its forward end to its rearward end. If there is any liquid in the materials in the container, the inclined floor causes the liquid to remain in the forward area of the container out of contact with the tail gate during collection and transport. A liquid collection tank may be positioned beneath floor 46 at the forward end thereof if so desired.

Figure 6:
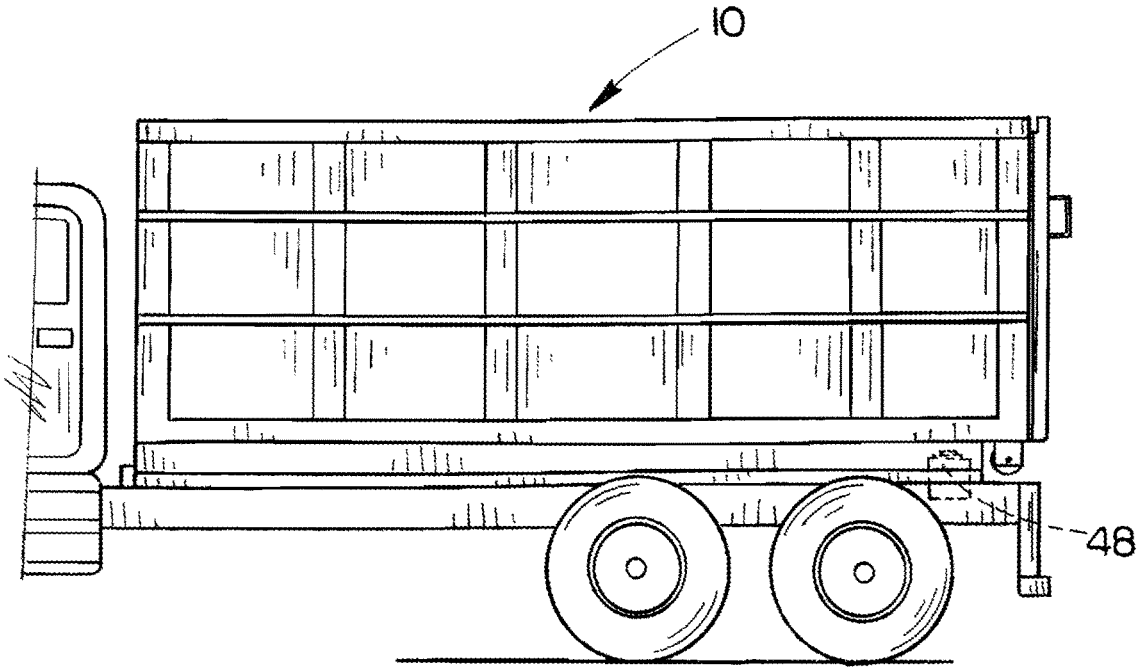
FIG. 6 is a side view of a further embodiment of the invention positioned on a truck.
Figure 7:
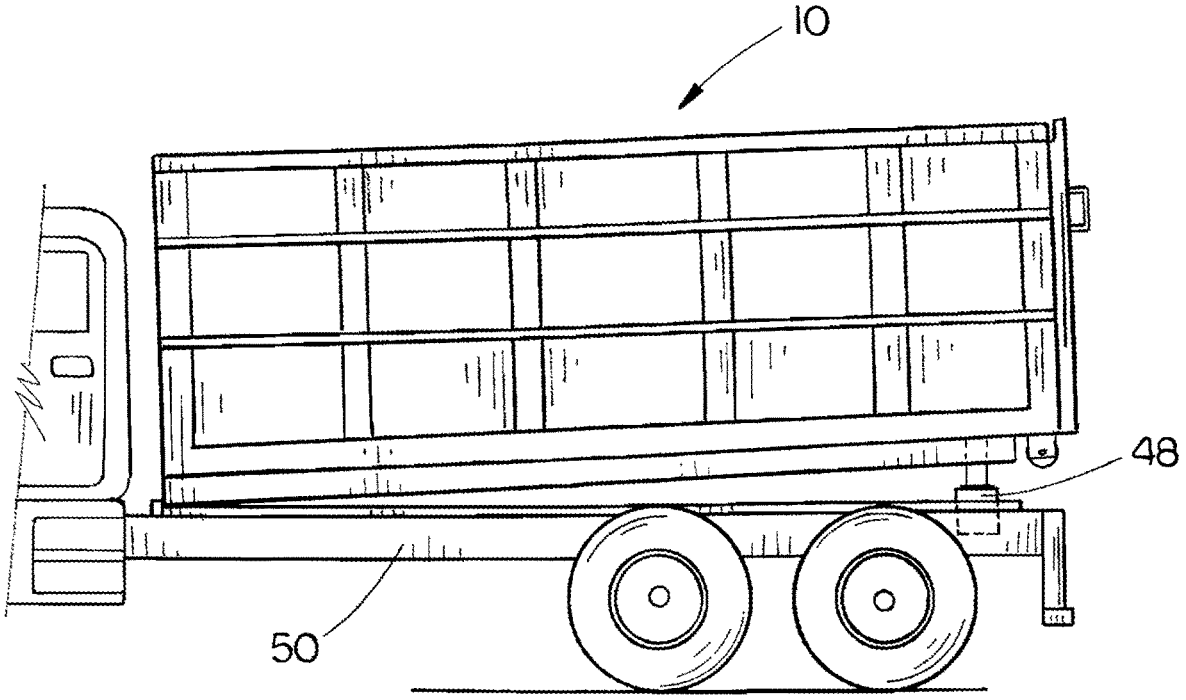
FIG. 7 is a side view of the embodiment of the invention of FIG. 6 which illustrates the rearward end of the container in an elevated position.

FIGS. 6 and 7 illustrate a further embodiment of the container. Hydraulic cylinders or pneumatic springs 48 are positioned between the frame 50 of the transporting vehicle and the container 10 so that the rearward end of the container may be elevated during transport. If the container 10 includes a pair of longitudinally extending frame members at the underside of the floor, the hydraulic cylinders or other elevating structure could be provided between the floor of the container and those frame members so that the rearward end of the container may be elevated during collection and transport. A liquid storage tank may be positioned beneath the floor of the container of FIGS. 6 and 7.

Figure 8:
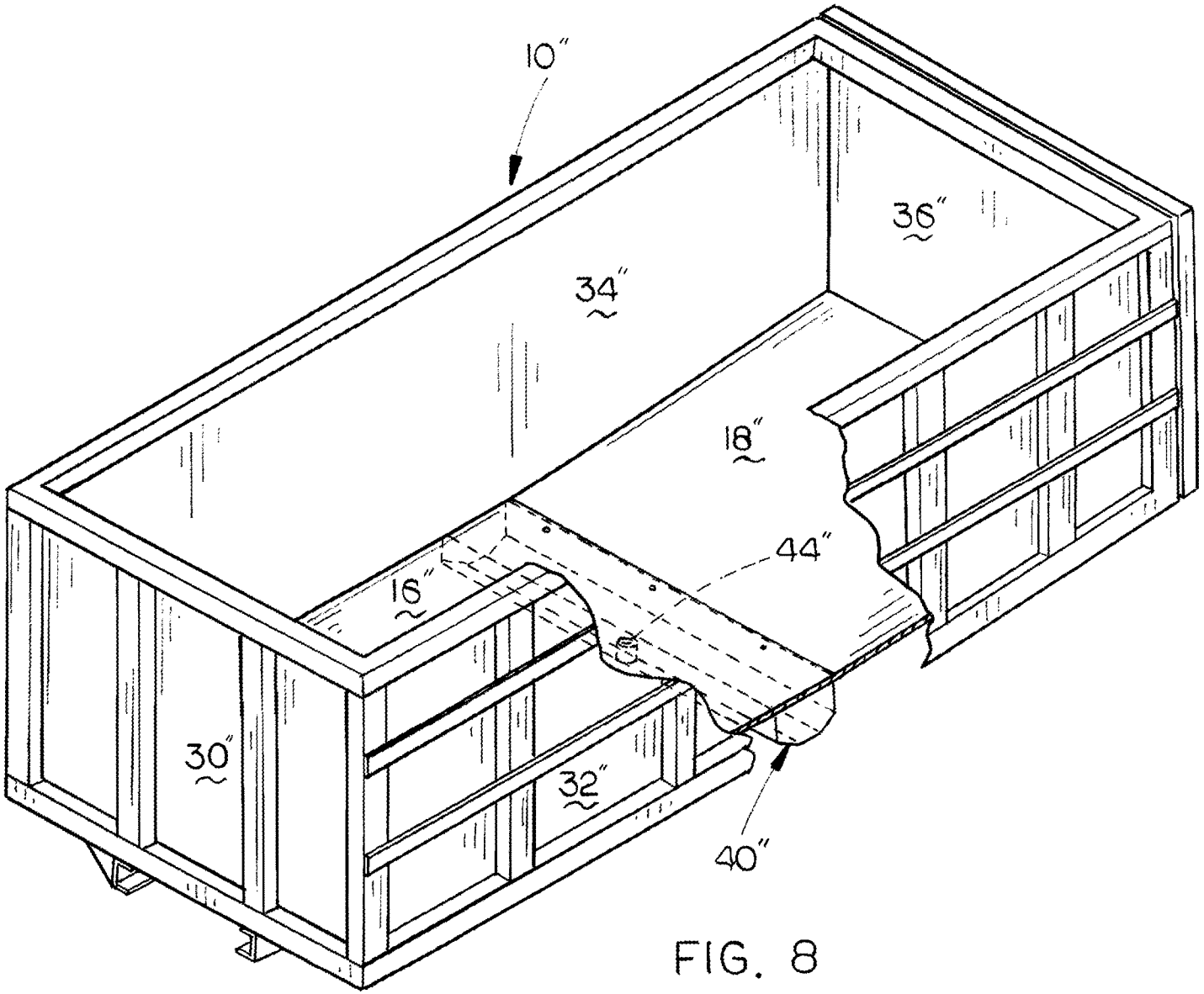
FIG. 8 is a front perspective view of a further embodiment of the invention with portions thereof cut-away to more fully illustrate the invention.
Figure 9:
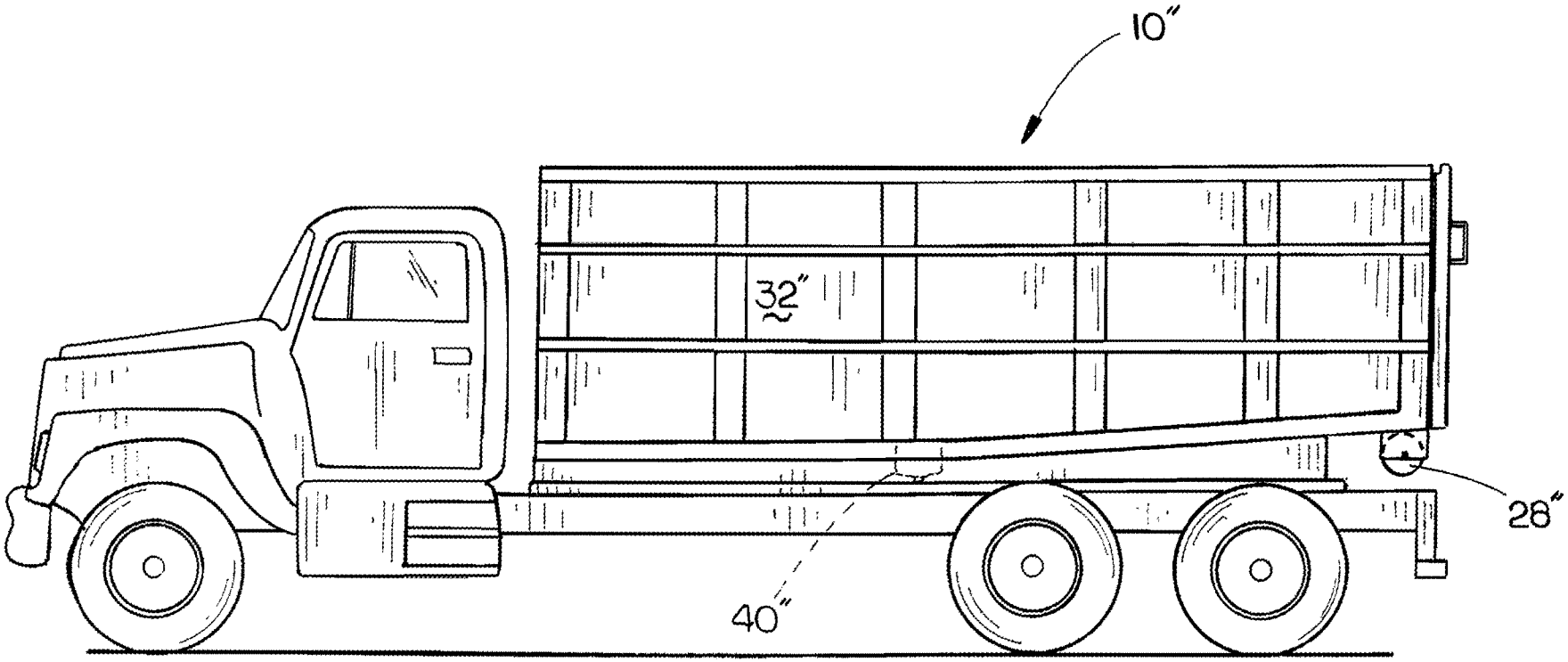
FIG. 9 is a side view of the embodiment of FIG. 8.

FIGS. 8 and 9 illustrate a further embodiment of the container which is designated by the reference numeral 10". Container 10" is substantially identical to container 10 except that the inclined rear floor portion 18" extends further forwardly than does the inclined floor portion 18 of container 10. It is preferred that the length of floor portion 18" be about 10 feet with the rearward end thereof being approximately 3 inches above the forward end thereof. The liquid collection tank 40" is located at the forward end of floor portion 18" with the container 10" functioning in the same fashion as container 10. In FIGS. 8 and 9, like structure in container 10" is designated "'".

Figure 10:
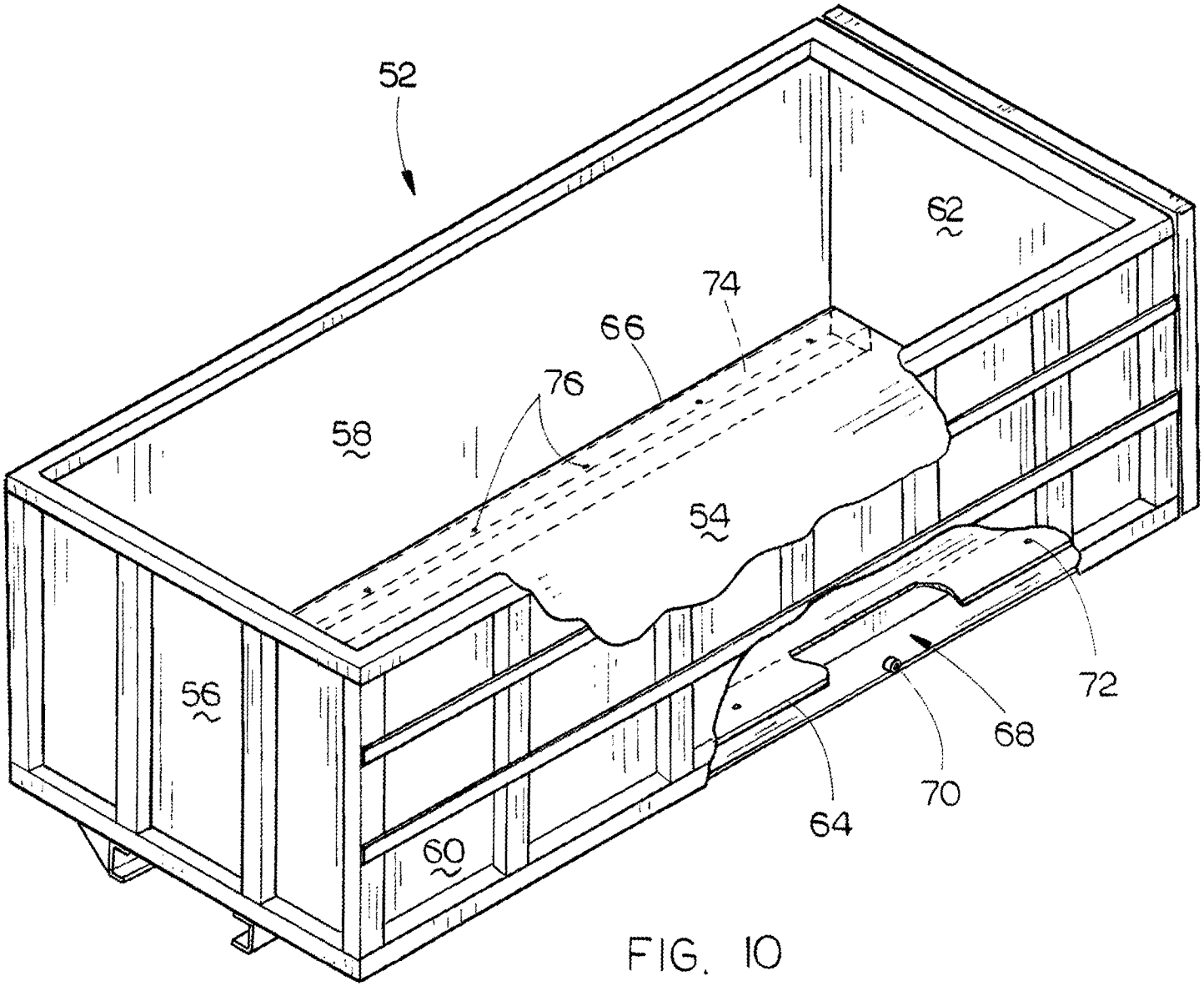
FIG. 10 is a front perspective view of a further embodiment of the invention with portions thereof cut-away to more fully illustrate the invention.
Figure 11:
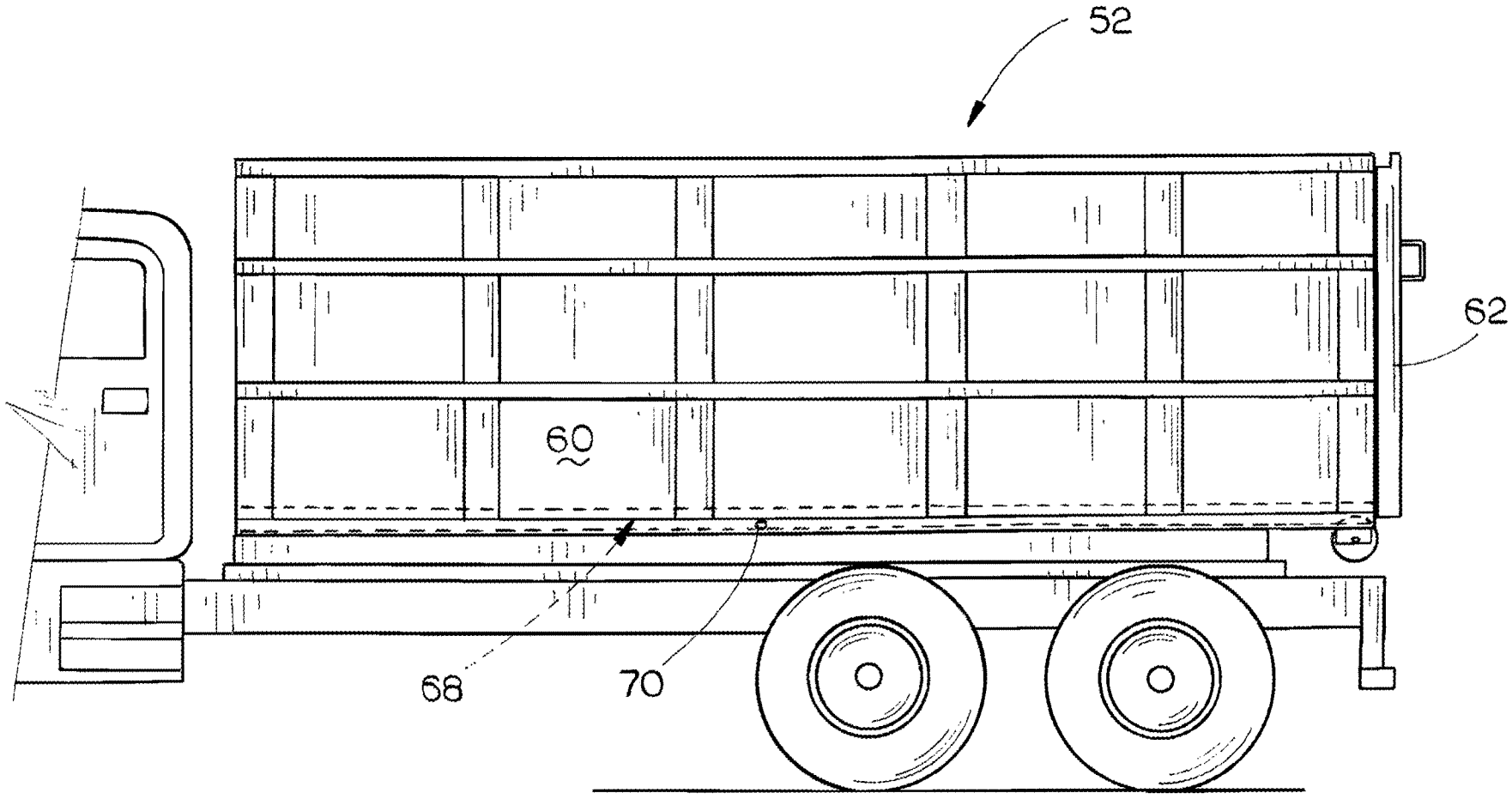
FIG. 11 is a side elevational view of the embodiment of FIG. 10.

A further embodiment of the container of this invention is illustrated in FIGS. 10 and 11 with the container being designated by the reference numeral 52. The container 52 has a horizontally disposed floor 54 positioned at the lower ends of walls 56, 58 and 60 and tailgate 62. Floor 54 has a first side 64 and a second side 66. An elongated liquid collection tank 68 is positioned beneath the floor 54 of container 52 at one side thereof and extends between the forward and rearward ends of floor 54. Tank 68 has a selectively closable discharge opening 70 to permit liquid within tank 68 to be drained therefrom. Floor 54 has a plurality of spaced-apart openings 72 formed therein which communicate with the interior of tank 68 to permit liquid within container 52 to drain therefrom into the tank 68.

An elongated liquid collection tank 74 is positioned beneath the floor 54 of container 52 at the other side thereof and extends between the forward and rearward ends of floor 53. Tank 74 has a selectively closable discharge opening formed therein (not shown) which is identical to opening 70 in tank 68 to permit liquid within tank 74 to be drained therefrom. Floor 54 has a plurality of spaced-apart openings 76 formed therein which communicate with the interior of tank 74 to permit liquid within container 52 to drain therefrom into the tank 74.

Thus, if the contents of the container 52 should have liquid associated therewith, the liquid will drain into tanks 68 and 74 and will not leak through the tailgate of the container. The liquid in the tanks 68 and 74 will be drained into a suitable receptacle at a predetermined location.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A roll-off tub style container, comprising:

a floor having a forward end, a rearward end, a first side and a second side;

said floor having an underside;

an upstanding front wall at said forward end of said floor;

a first upstanding side wall at said first side of said floor;

a second upstanding side wall at said second side of said floor;

each of said first and second side walls having forward and rearward ends;

and a tail gate selectively closing the rearward ends of first and second side walls and said floor;

a first elongated liquid collection tank beneath the underside of said floor at said first side of said floor which extends between said forward and rearward ends of said floor;

said floor having a plurality of horizontally spaced-apart first openings formed therein which are positioned above said first liquid collection tank so as to be in communication with the interior of said first liquid collection tank so that liquid in the container may drain into said first liquid collection tank;

said first liquid collection tank having a discharge opening for selectively draining liquid in said first liquid collection tank;

and a second elongated liquid collection tank beneath the underside of said floor at said second side of said floor which extends between said forward and rearward ends of said floor;

said floor having a plurality of horizontally spaced-apart second openings formed therein which are positioned above said second liquid collection so as to be in communication with the interior of said second liquid collection tank so that liquid in the container may drain into said second liquid collection tank;

said second liquid collection tank having a discharge opening for selectively draining liquid in said second liquid collection tank.

* * * * *